United States Patent [19]

Gunold

[11] 3,948,194

[45] Apr. 6, 1976

[54] SEWING MACHINE ACCESSORY APPARATUS

[76] Inventor: Heinz Gunold, Obernburger Str. 125, 8751 Stockstadt, Germany

[22] Filed: July 23, 1973

[21] Appl. No.: 381,892

[52] U.S. Cl. ..... 112/131; 112/218 R

[51] Int. Cl.[2] ..... A41H 1/06; D05B 35/00

[58] Field of Search ..... 112/218 R, 130, 129, 122, 112/131, 128, 220, 221

[56] References Cited

UNITED STATES PATENTS

| | | | |
|---|---|---|---|
| 1,009,324 | 11/1911 | Littelfield et al. | 112/131 X |
| 1,156,580 | 10/1915 | Benjamin | 112/131 X |
| 1,550,418 | 8/1925 | Bates | 112/129 |
| 1,947,495 | 2/1934 | Routtenberg | 112/129 |
| 2,140,416 | 12/1938 | Collar | 112/130 X |
| 2,787,677 | 4/1957 | Seaman | 112/130 X |
| 3,170,349 | 2/1965 | Weinkle | 112/130 X |
| 3,311,076 | 3/1967 | Farabee | 112/129 |
| 3,329,113 | 7/1967 | Lewis et al. | 112/130 |
| 3,376,836 | 4/1968 | Nicolay | 112/122 |

FOREIGN PATENTS OR APPLICATIONS

| | | | |
|---|---|---|---|
| 231,701 | 7/1944 | Switzerland | 112/131 |

*Primary Examiner*—H. Hampton Hunter
*Attorney, Agent, or Firm*—Fulwider, Patton, Rieber, Lee & Utecht

[57] ABSTRACT

A sewing machine accessory device including a solenoid actuated rod adapted to be extended in selected combination within a stitch advance sequence of the sewing machine for selectively piercing the fabric by tools attached thereto in coordinated combination with a particular sewing sequence. In another embodiment the tools attached include a color dispenser extended selectively to contact the fabric, or a plurality of color dispensers radially disposed for rotation to contact selectively the fabric.

3 Claims, 9 Drawing Figures

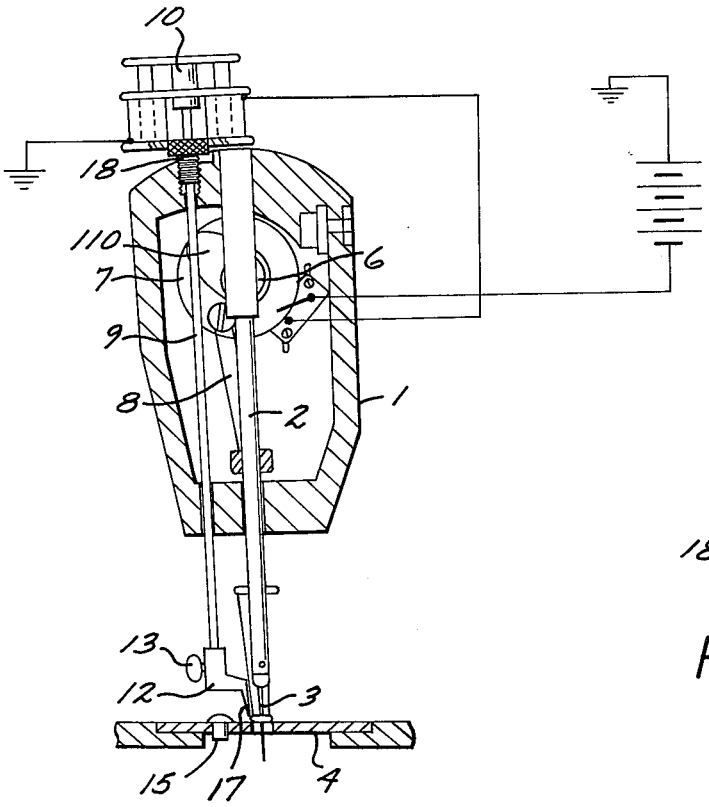
FIG. 3
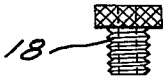
FIG. 4
FIG. 5
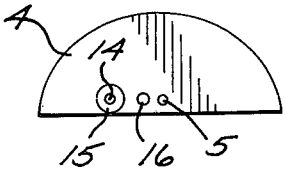
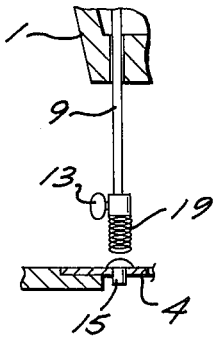
FIG. 6

SEWING MACHINE ACCESSORY APPARATUS

BACKGROUND OF THE INVENTION

1. Field of the Invention

This invention relates to an accessory apparatus for an automatic sewing machine including a vertically movable needle cooperating with a hole located in a hole plate.

2. Description of the Prior Art

Accessory attachments for automatic sewing machines are typically directed at facilitating penetration of various materials both with a normal thread and with a heavy thread. Such devices, however, are typically not adapted for high speed stitching of hole designs, i.e. RICHELIEU stitching, or button holes where the holes have to be trimmed or cut out subsequently by hand with the help of a scissors or other cutting tool requiring the stopping of the machine between the stitching and cutting steps. This method of operation lacks efficiency because not only time is lost, but also a complete operation cannot be performed in an automatic fashion to associate with other automated processes. Manual cutting, in addition, lacks the requisite precision and repeatability of automated cutting. Such prior art automatic sewing machines furthermore consecutively stitch the complete patterns leaving a connecting thread between the individual figures of the pattern which has to be cut off by hand.

SUMMARY OF THE INVENTION

Accordingly, it is the general purpose and object of the present invention to provide an accessory attachment for an automatic sewing machine facilitating a completely automatic procedure, without stopping or slowing down the machine. Further objects are to provide an attachment adapted to perform not only normal fabric stitching but also to perform hole punching of leather and artificial leather in conjunction with a sewing sequence, such attachment being fully automatic, eliminating any manual tasks of cutting connecting threads.

Briefly, these and other objects are accomplished by providing an actuating rod located in or next to the sewing head conventionally geared to extend a cutter or various color pens. Such actuating rod can also attach a die punch to produce various hole patterns in leather and plastic sheets in combination with the conventional process of stitching. The attachment of a cutting tool in conjunction with the inventive attachment further allows performance of completely automatic hole stitching and cutting in woven fabric without stopping or slowing down the machine. Furthermore, by attaching one or more color dispensers to the actuating rod, it is possible to stitch and color a figure or a plurality of figures that repeat themselves next to one another, such figures being marked and overstitched in one operation, the cutting of the connecting thread being also eliminated. The articulation of the color dispensers as well as the die and cutting tool is achieved in a conventional manner in association with the motion of the needle arm by a solenoid together with a return spring. In each case the selected tool is geared in a conventional manner to cooperate with the machine stroke providing any desired effect as well as a punched effect on the finished product.

A selection of an assortment of different color dispensers can also be mounted on a rotating head attached to the actuating rod, where the particular color that is needed to print a particular figure of the pattern is selected by a selecting cam engaging a solenoid which drives a ratchet wheel. In this manner, it is possible to utilize several color dispensers with different colors to achieve a versatile pattern involving various stitching effects.

BRIEF DESCRIPTION OF THE DRAWINGS

FIG. 3 is a cross sectional front view of the accessory attachment of FIG. 2 showing the drill in a rest position;

FIG. 4 is a view of a positioning screw useful in adjusting the working depth of an actuating rod according to the present invention;

FIG. 5 is a top view of a plate modified to be used in combination with the sewing head aand the inventive accessory attachment;

FIG. 6 is a front view of yet another embodiment of the die punch including an attached spring;

DESCRIPTION OF THE SPECIFIC EMBODIMENTS

Conventinal sewing machines have been automated in the past to produce various stitch patterns. Most frequently such machines includes an eye-pointed reciprocating needle carrying an upper thread through the layers of fabric to form a loop beneath the fabric. A shuttle carrying a bobbin of under thread passes through the loop, or a rotary hook takes the loop and passes it around the bobbin, to form a lock stitch. The various feed dimensions or stitch dimensions or stitch patterns are selected by an intermittent feed arrangement responsive to selected stitch cams geared to the drive shaft driving the reciprocating needle arm. The present invention is directed at providing an accessory device for extending various cutting or coloring tools in associated relationship with a stitch pattern, such accessory device comprising an actuating rod 9 articulated to extend an attached tool towards the fabric by the energization of a solenoid 10 connected in circuit to a limit switch which is selectively closed by a selected tool cam also disposed on the drive shaft. Accordingly, the needle and the actuating rod are articulated at various angular positions of the main drive shaft to produce any desired combination.

Figure 1:
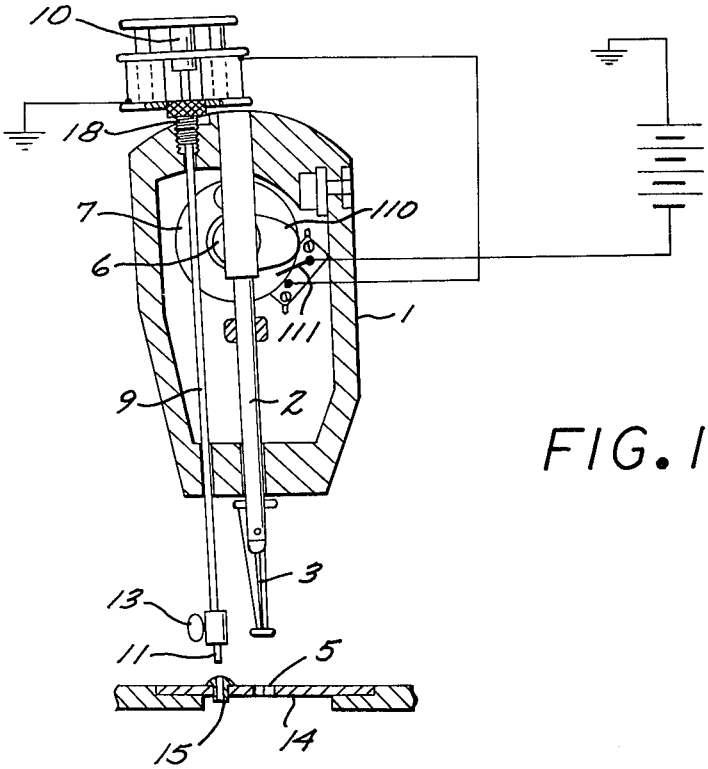
FIG. 1 is a front elevation view in partial cross section of a sewing head of an automatic sewing machine including a first embodiment of the inventive accessory attachment incorporating a die punch.
Figure 2:
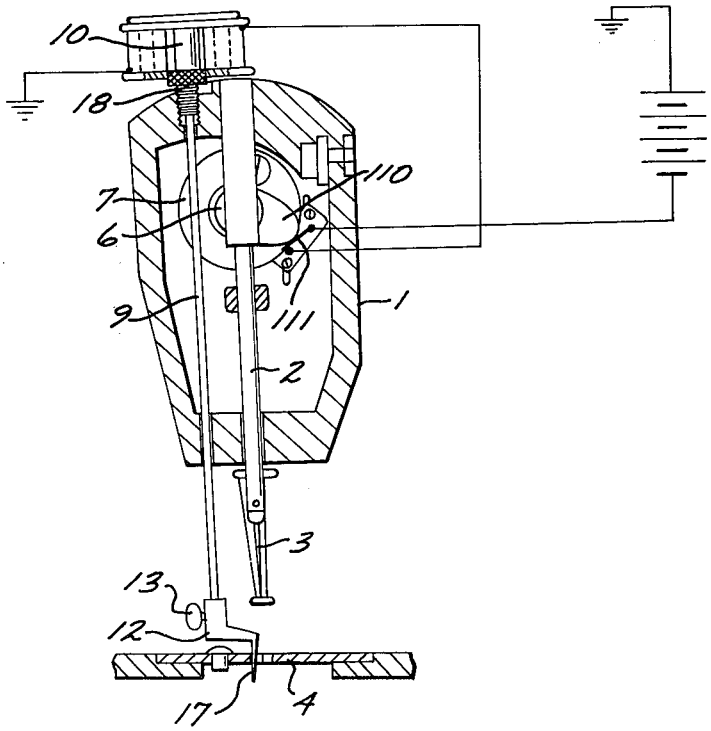
FIG. 2 is a cross sectional front view of yet another embodiment of the accessory attachment incorporating a cutter.

As shown in FIGS. 1 through 3, a sewing head 1 of a high speed multistitch sewing machine includes a central vertically movable needle arm 2 which receives on its bottom free end an eye-pointed needle 3, the reciprocal motion of the needle arm 2 being geared in a conventional manner with the motion of the article over plate 4, including a stitch hole 5. A conventional driving mechanism (not shown) guided by a cam pattern formed on the stitch cams of the sewing machine articulates the stitched material in combination with the needle arm 2 in such sewing head 1 of the sewing machine, the arm 2 being driven by a common drive shaft 6, terminating in a crank 7 which engages the arm 2 across a connecting rod 8.

The inventive accessory device is adapted to be attached to the sewing head 1 of the automatic sewing machine, aligning the actuating rod 9 substantially parallel and laterally separated from the needle arm 2 to reciprocate in an independent parallel vertical up and down stroke by a periodic force produced by a solenoid 10 located above the head 1 adjustably receiving the top end of the actuating rod 9. The solenoid 10 is periodically energized by a limit switch closed by a stitch cam to force the rod 9 against a selected opposing surface of the plate 4. In this manner, the driving stroke of the actuating rod 9 and the arm 2 can occur at unrelated positions of the drive shaft to produce selected combinations of combined performance described in more detail hereinbelow.

More specifically, the lower end of the actuating rod 9, directed at the plate 4, is adapted for exchangeable attachment to which, in the example of FIG. 1 a die punch 11 is secured, and for the example in FIG. 2 a cutter 12 is attached.

The punch 11 is securely fastened by a lockscrew 13 to the lower free end of the actuating rod 9 being driven in opposition against a die punch hole 14 located in the plate 4 shown in FIG. 5, located apart from stitch hole 5 at a position on the plate 4 directly opposite the actuating rod 9. In order to punch various selected size holes in leather and other materials, the punch hold 14 in the plate 4 is included in a removable die 15 which can be selectively attached therein by threaded engagement. In this manner different size die punch holes can be made in the article.

As shown in FIG. 2, a cutter 12 terminating in a cutter tip 17 is attached to the lower or free end of rod 9, being secured again by the lockscrew 13 to cooperate with a cutter hole 16 located in the plate 4 again separated from stitch hole 5. The cutter tip 17 is laterally displaced relative the axis of rod 9 in the direction of the needle 3 so that the separation distance between the cutter hole 16 and the stitch hole 5 is smaller than the normal distance between the punch hole 14 and the stitch hole 5, it being often desired to cut the fabric immediately adjacent the stitch. Thus the cutter hole 16 is located close to the stitch hole 5 to bring the cutter tip 17 as close as possible to the stitch needle 3 without damaging the stitch hole 5 in the plate 4. The cutting and stitching in a single stitch hole is thus eliminated, precluding damage of the stitch thread by the sharp edges on the cutter tip 17 contacting the edges of the hole. Furthermore such offset location of the cutter hole 16 relative the axis or rod 9 is possible because the cutting of fabric requires minimal force while in other cases, i.e. the die punch 11, the end of the tool is axially aligned with the actuating rod 9, allowing for punching leather and artificial leather which requires significantly more force.

In order to be able to selectively change the depth of the stroke of the actuating rod 9, and consequently the penetrating of the tools that are attached thereto, i.e. either the die punch 11 or the cutter 12, a threaded adjustment screw 18, shown in FIG. 4, is provided, located on the underside of the solenoid 10 to adjustably receive the actuating rod 9 therein. FIGS. 1 through 3 illustrate the working depth of the actuating rod 9 thereby selected through the adjustment of the adjustment screw 18.

In operation, the actuating rod 9 and the needle arm 2 are geared to extend at independent increments of the stitch stroke, being coupled by conventional means to selected stitch cams. Accordingly, when the needle 3 is penetrating the fabric the actuating rod 9 is in a motionless withdrawn position. Thus, if it is desired to adorn leather or artificial leather with hole patterns then the die punch 11 is attached to the actuating rod 9, conventionally coupled to its own cam (not shown) to be driven in a vertical up and down motion by the solenoid 10 at a selected opposing relationship with the feed plate 4, providing the article with the desired hole pattern while the stitching is done.

If cutouts are desired in the fabric, then the die punch 11 is removed from the actuating rod 9 and is replaced by the cutter 12, as shown in FIG. 2. The needle arm 2 is conventionally geared to move first, allowing the needle 3 to penetrate with a stitch in the article followed by the cutting stroke of the rod 9. During each cutting stroke, the article is conventionally translated below the cutter tip 17. According to this procedure, any selected sequence may be performed in a conventional manner by the proper selection of the stitch cams.

The distance between stitch hole 5 and the cutter hole 16 is kept to a minimum allowing for the various cutting and stitching sequences and limiting the amount the article is moved from stitch hole 5 to the cutter hole 16 and back, to thereby limit the required length of upper or lower thread which is thus extended in the process. The slack of the upper thread may be pulled back by the conventional thread pull lever, leaving the lower thread to form a small bow which, however, is stitched over by the stitching operation which follows the cutting. It is of course possible to retract the length of lower thread which has been pulled out by the addition of a conventional thread tensioning device, where by such formation of a bow is eliminated.

As is shown in FIG. 6, the punch 11 is further equipped with a compression spring 19 on the free end thereof for urging the article against the hole die when the die punch 11 pulls out from the punched leather hole. This prevents the pulling up of the article as the die punch 11 is withdrawn.

Figure 7:
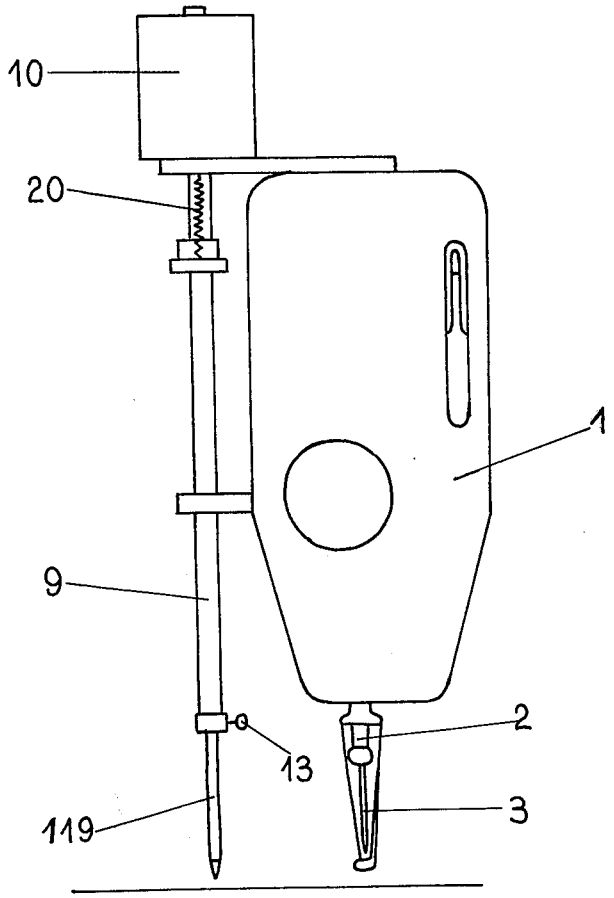
FIG. 7 is a front view of yet another embodiment illustrating the sewing head in combination with a side attached actuating rod having a color dispenser.

As shown in FIG. 7, yet another embodiment includes the actuating rod 9, which in this case is located on the side of the stitching head 1, being reciprocated in a vertical up and down direction by the solenoid 10 to lower a color dispenser 119 which is again attached with the lockscrew 13. Thus, the color dispenser 119 is removable and can be exchanged with other pins of different colors. The actuating rod 9 is extended in response to cam 110, extending to deposit color when the color dispenser 119 hits the article. After these steps the color dispenser 119, or actually the actuating rod 9, is pulled back by a tension spring 20 to its rest position.

It is to be noted that the gearing of the actuating rod 9 with the needle 3, is provided by a selectable stitch cam 110 included in a cam assembly 21 attached to the common drive shaft 6 of the sewing machine, which is adjustable in angular position on the main drive shaft by the use of a position screw 22. This cam assembly 21 drives both the limit switch 111 and a limit switch 23 to energize the solenoid 10 for actuation of rod 9 and other solenoids.

Figure 8:
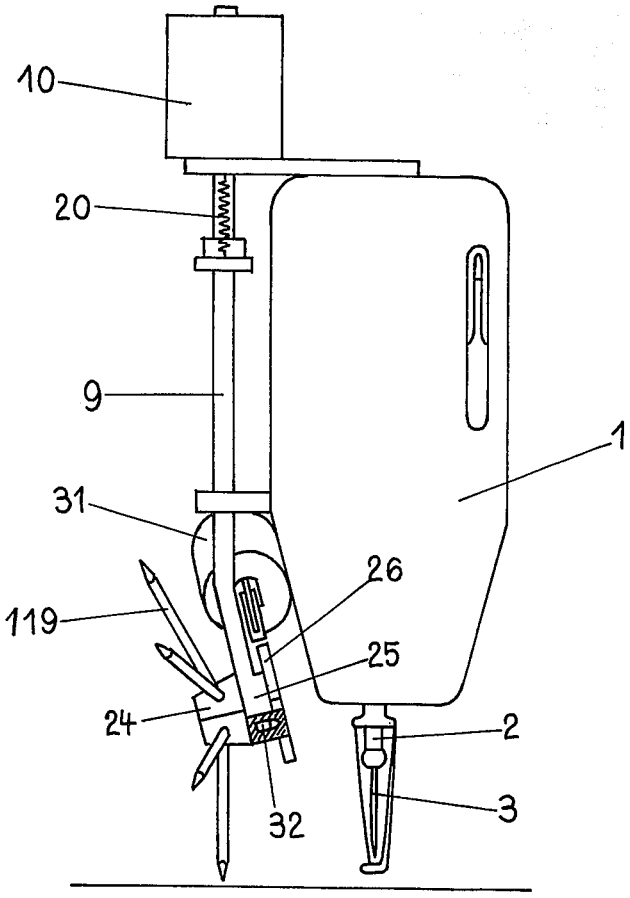
FIG. 8 is a front view of the sewing head including yet another embodiment of a color dispenser.
Figure 9:
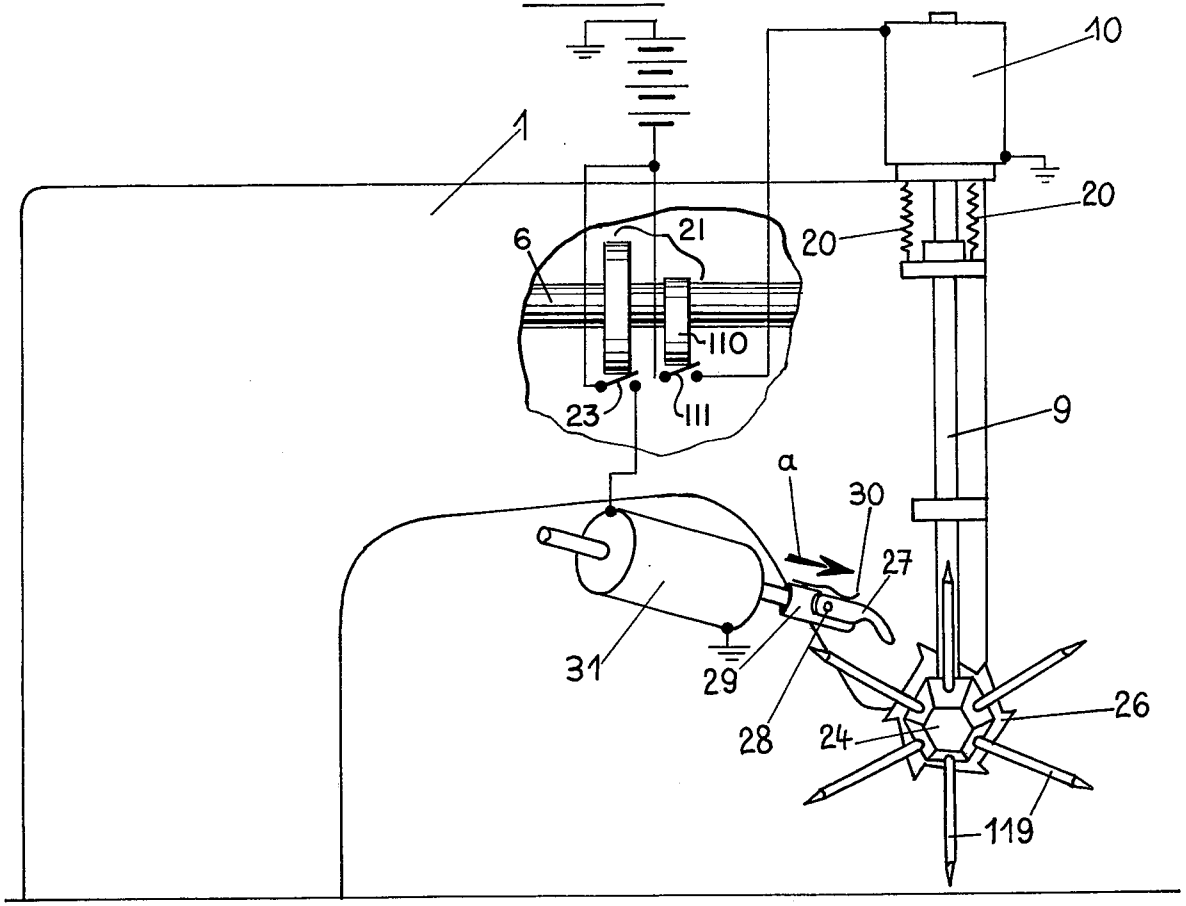
FIG. 9 is a side view of the embodiment shown in FIG. 8.

A further embodiment illustrating one modification of the basic idea is shown in FIGS. 8 and 9 where the inventive attachment on the end of the actuating rod 9 provides a plurality of color dispensers 119 mounted to extend radially at equal increments of arc from a rotating attachment head 24, which is mounted on a bearing 25 for rotation at the lower free end of the actuating rod 9. The attachment head 24 can be equipped with any desired number of coloring dispensers 119 illustrated in the example in FIG. 9, as six color dispensers 119 of different colors.

The head 24 is controllable in rotation by a ratchet plate 26 located distally across bearing 25 for common rotation. This ratchet plate 26 is rotated by means of a ratchet lever 27 which is attached through a movable pin joint 28 to lever holder 29. A flat spring 30 maintains lever 27 in extended position, as shown in FIG. 9. The lever holder 29 is a part of a reciprocating solenoid 31 which is again conventionally controlled by means of yet another selected stitch cam, which like cam 110 closes switch 23 so that the lever holder 29 with the ratched lever 27 moves in the direction of the arrow *a* and return in the opposite direction. In this manner it is possible to extend the lever 27 against a tooth of the plate 26 to provide predetermined selection of the color dispensers 119. Thus, the color dispensers 19 can be stepped sequentially in a downward position, which permits the selection of any color combination.

Once in position every selected color dispenser 119 is retained in its work position by a conventional stopping device 32, such as the well known spring loaded ball which is located on the free end of the actuating rod 9, whereby a position index is provided for the movement of the color dispenser 119 from one working position to another, in cooperation with a plurality of depressions formed on the inside of the ratchet plate 26.

In operation, the various color pens 119 on the actuating rod 9 are pulled up by tension springs 20, being thus pulled to a rest position during the stitching of a stitch pattern by needle 3. During this sequence the solenoid 10 receives no impulses so that the color dispenser 119 remains in its upper rest position. When the desired stitch pattern is completed and it is required to color a figure in the same pattern of the stitch area, the article is manually translated laterally to align under the color dispenser 119 in position over the starting point of the figure. When the article has reached the desired correct position, then the figure that is to be colored will be colored by means of the control of the selected stitch cam driving the solenoid 10. If it is required that a second figure is to be made in color and with a given distance from the first, then the article must be moved accordingly, again manually, so that the color dispenser 119 is then positioned over the starting point of the next figure.

Thus, if figures are to be made in different colors, then the attachment shown in FIGS. 9 and 8 is useful because no manual change is required of the dispensers 119, as is the case for FIG. 7, every time a different color is needed. The different colors used and the translation of the article are controlled by the convenient sequencing devices, such as the aforementioned stitch cams, which initiate the impulse for the solenoid 31, causing the change of the colors by the turning of the head 24. In order to save time, the color changing movement may be preformed concurrent with the movement of the stitch frame. Such selected programming may be provided together with the conventional automatic cam programming of any stitching pattern. As is shown in the illustrations of FIGS. 8 and 9, the rotating head 24 together with the color dispensers 119, as well as the plate 26, is only turnable in one direction and only by one increment of movement. When it is necessary to rotate over more than one sequential selection, the solenoid 31 and ratchet lever 27 are repeatedly actuated to bring the color dispensers of the desired color to the work position, such being provided in the programming of the stitch cams.

Obviously, many modifications and variations of the present invention may be made with regard to the foregoing detailed description without departing from the spirit of the invention.

I claim:

1. In an automatic sewing machine for stitching an article, including a needle arm disposed for vertical translation on the sewing head of the machine, said needle arm having a needle secured to the lower end thereof, means for vertically translating said arm, a plate aligned in opposing relationship below said needle arm and means for translating the article to a preselected stitch pattern, the improvement comprising:

an actuating rod disposed for vertical translation in substantially parallel alignment with said needle arm adapted to attach to a selected tool at the lower end thereof;

means for selectively coordinating the vertical translation of said actuating rod with the feeding translation of said article;

a mounting head secured for rotation to the free end of said actuating rod along an axis substantially transverse to the longitudinal axis of said rod;

a plurality of color dispensers mounted to radially extend from said mounting head; and selecting means operatively connected to said mounting head for selecting an angular orientation thereof.

2. Apparatus according to claim 1 wherein:

said mounting head includes a ratchet plate and said selecting means includes a ratchet lever, said lever cooperating to turn said ratchet plate by a predetermined angular increment upon extension thereof.

3. Apparatus according to claim 2 further comprising:

detent means operatively connected between said actuating rod and said mounting head for releasably engaging said mounting head to said rod at selected angular orientations.

* * * * *